US010663211B2

(12) United States Patent
Chen et al.

(10) Patent No.: US 10,663,211 B2
(45) Date of Patent: May 26, 2020

(54) METHODS AND SYSTEMS FOR CHECKING PROPER AIRFLOW WITHIN A CONTAINER

(71) Applicant: Carrier Corporation, Palm Beach Gardens, FL (US)

(72) Inventors: Yu H. Chen, Manlius, NY (US); Giorgio Rusignuolo, Manlius, NY (US); Marc Beasley, Beverly, MA (US); Luke DiMaggio, Anderson, SC (US); Kartik Kumar, Voorburg (NL)

(73) Assignee: CARRIER CORPORATION, Palm Beach Gardens, FL (US)

( * ) Notice: Subject to any disclaimer, the term of this patent is extended or adjusted under 35 U.S.C. 154(b) by 72 days.

(21) Appl. No.: 16/061,355

(22) PCT Filed: Dec. 8, 2016

(86) PCT No.: PCT/US2016/065506

§ 371 (c)(1),
(2) Date: Jun. 12, 2018

(87) PCT Pub. No.: WO2017/105983

PCT Pub. Date: Jun. 22, 2017

(65) Prior Publication Data

US 2018/0372392 A1 Dec. 27, 2018

Related U.S. Application Data

(60) Provisional application No. 62/269,199, filed on Dec. 18, 2015.

(51) Int. Cl.

| | |
|---|---|
| ***F25D 17/06*** | (2006.01) |
| ***F25D 11/00*** | (2006.01) |
| ***F25D 29/00*** | (2006.01) |

(52) U.S. Cl.
CPC ..... *F25D 17/067* (2013.01); *F25D 11/003* (2013.01); *F25D 17/06* (2013.01);
(Continued)

(58) Field of Classification Search
CPC ..... F25D 11/003; F25D 17/63; F25D 29/003; F25D 29/009; F25D 2700/06; F25D 2700/12; F25D 17/06; F25D 17/067
See application file for complete search history.

(56) References Cited

U.S. PATENT DOCUMENTS 3,359,749 A 12/1967 Howland et al.
5,692,385 A * 12/1997 Hollenbeck ..... F25D 21/002 62/140

(Continued)

FOREIGN PATENT DOCUMENTS

| | | | |
|---|---|---|---|
| DE | 102011078191 | A1 | 1/2013 |
| KR | 20140013264 | A | 2/2014 |
| WO | 2010139040 | A1 | 12/2010 |

OTHER PUBLICATIONS

"Cargo Monitoring, Real-Time Visibility and Control"; Purfresh Inc.; 2015; retrieved from Internet; URL: http://www.purfresh.com/cargo_monitoring.php; 2 pgs.

(Continued)

*Primary Examiner* — Marc E Norman
(74) *Attorney, Agent, or Firm* — Cantor Colburn LLP

(57) ABSTRACT

Systems and methods for checking proper airflow within a container (307) having a refrigeration unit (320) are provided. The system includes one or more sensors (358) located within the container configured to measure at least one airflow characteristic, and a controller (360) in communication with the one or more sensors. The controller is configured to store predetermined information related to airflow within the container, wherein the predetermined information includes minimum airflow criteria related to the (Continued)

at least one airflow characteristic, receive data from the one or more sensors, compare the received data with the predetermined information, and provide an indicator when the comparison indicates that the received data does not meet or exceed the minimum airflow criteria.

16 Claims, 5 Drawing Sheets

(52) U.S. Cl.
CPC ..... *F25D 29/003* (2013.01); *F25D 29/008* (2013.01); *F25D 2700/06* (2013.01); *F25D 2700/12* (2013.01)

(56) References Cited

U.S. PATENT DOCUMENTS

| | | | |
|---|---|---|---|
| 6,862,499 | B1 | 3/2005 | Cretella et al. |
| 8,959,036 | B2 | 2/2015 | Huat |
| 2006/0164239 | A1 | 7/2006 | Loda |
| 2007/0006600 | A1 | 1/2007 | Manettas et al. |
| 2008/0117040 | A1 | 5/2008 | Peel et al. |
| 2008/0129490 | A1 | 6/2008 | Linville et al. |
| 2008/0270076 | A1 | 10/2008 | Breed |
| 2009/0056353 | A1 | 3/2009 | Sunderland |
| 2011/0221573 | A1 | 9/2011 | Huat |
| 2012/0000212 | A1 | 1/2012 | Sanders |
| 2013/0271290 | A1 | 10/2013 | Saenz et al. |
| 2013/0327068 | A1 | 12/2013 | Lee et al. |
| 2013/0342343 | A1 | 12/2013 | Harring et al. |

OTHER PUBLICATIONS

Bielsa et al.; "Wireless Sensor Networks enhancing the efficiency and safety of logistics operations", Libelium; Jan. 2012; 5 pgs.
International Search Report, International Application No. PCT/US2016/065506, dated Mar. 27, 2017, European Patent Office; International Search Report 5 pages.
International Written Opinion, International Application No. PCT/US2016/065506, dated Mar. 27, 2017, European Patent Office; International Written Opinion 7 pages.
Jedermann, et al., "Applying Autonomous Sensor Systems in Logistics Combining Sensor Networks, RFIDs and Software Agents"; Proceedings of the EUROSENSORS XIX conference, Sep. 11-14, 2005, Barcelona, Spain, vol. I, Section TC5; 4 pgs.
Reefer Cargo Handling; retrieved from Internet; URL: http://www.csavnorasia.com/en/ProductsServices/Products/ReferSolution/Pages/ReeferCargoHandling.aspx (2015) 2 pgs.

* cited by examiner

METHODS AND SYSTEMS FOR CHECKING PROPER AIRFLOW WITHIN A CONTAINER

CROSS REFERENCE TO RELATED APPLICATIONS

This is a U.S. National Stage of Application No. PCT/US2016/065506, filed on Dec. 8, 2016, which claims the benefit of U.S. Provisional Patent Application No. 62/269,199, filed on Dec. 18, 2015, the disclosures of which are incorporated herein by reference.

BACKGROUND

The subject matter disclosed herein generally relates to containers for cargo and, more particularly, to systems and methods for checking proper airflow within a container having a refrigeration unit.

A shipping container is a container with strength suitable to withstand shipment, storage, and handling. Various shipping containers in the transportation of cargo may include refrigeration units and/or systems. The cargo in such containers could be any type of cargo requiring climate control and/or protection from "hot" or "cold" conditions. Refrigeration units may be married to and/or configured with an insulated box or container for the carriage of cargo and may include, but is not limited to, refrigerated containers, refrigerated trailers, refrigerated boxcars, refrigerated air cargo containers, refrigerated trucks, etc. The refrigeration unit controls the temperature of the conditioned air either delivered to and/or returning from the cargo space. A controller may be used to control air conditions within the container. For example, a controller may be used to monitor temperature and other conditions with a processor, and thus control a refrigeration unit for the regulation of conditioned air either delivered to and/or returning from a cargo space.

Cargo or other variables may impact airflow within the container after the container is loaded and closed. For example, cargo may fall or shift such that the airflow generated by the refrigeration unit is impeded, blocked, or otherwise obstructed or impacted. If this occurs, the cargo may be damaged due to lack of cooling or other air conditioning.

SUMMARY

According to one embodiment, a system for checking proper airflow within a container having a refrigeration unit is provided. The system includes one or more sensors located within the container configured to measure at least one airflow characteristic and a controller in communication with the one or more sensors. The controller is configured to store predetermined information related to airflow within the container, wherein the predetermined information includes minimum airflow criteria related to the at least one airflow characteristic, receive data from the one or more sensors, compare the received data with the predetermined information, and provide an indicator when the comparison indicates that the received data does not meet or exceed the minimum airflow criteria.

In addition to one or more of the features described above, or as an alternative, further embodiments of the system may include that at least one sensor of the one or more sensors is an airspeed sensor, wherein the measured airflow characteristic does not meet or exceed the minimum airflow criteria if the airflow speed sensor detects an airspeed below the minimum airflow criteria.

In addition to one or more of the features described above, or as an alternative, further embodiments of the system may include that at least one sensor of the one or more sensors is a proximity sensor, wherein the measured airflow characteristic does not meet or exceed the minimum airflow criteria if the proximity sensor detects an object within a predetermined proximity to a wall of the container.

In addition to one or more of the features described above, or as an alternative, further embodiments of the system may include that the indicator is one of a light or a noise provided at the container.

In addition to one or more of the features described above, or as an alternative, further embodiments of the system may include that the indicator is a message transmitted to a user.

In addition to one or more of the features described above, or as an alternative, further embodiments of the system may include a plurality of containers, each container having one or more sensors, the system further comprising the controller in communication with each of the plurality of containers.

In addition to one or more of the features described above, or as an alternative, further embodiments of the system may include that, when one container of the plurality of containers has associated received data that does not meet or exceed the minimum airflow criteria, the indicator is configured to identify which of the plurality of containers does not meet or exceed the minimum airflow criteria.

In addition to one or more of the features described above, or as an alternative, further embodiments of the system may include the predetermined information is based on a cargo configuration loaded into the container.

In addition to one or more of the features described above, or as an alternative, further embodiments of the system may include the controller is configured to perform an airflow check after loading of the container.

In accordance with another embodiment, a method for checking proper airflow within a container having a refrigeration unit is provided. The method includes loading, at a controller, predetermined information related to airflow within the container, wherein the predetermined information includes minimum airflow criteria, measuring, with one or more sensors, at least one airflow characteristic related to the predetermined information, receiving, at the controller, data from the one or more sensors, comparing the received data with the predetermined information, and providing an indicator when the comparison indicates that the received data does not meet or exceed the minimum airflow criteria.

In addition to one or more of the features described above, or as an alternative, further embodiments of the method may include that at least one sensor of the one or more sensors is an airspeed sensor, wherein the measured airflow characteristic does not meet or exceed the minimum airflow criteria if the airflow speed sensor detects an airspeed below the minimum airflow criteria.

In addition to one or more of the features described above, or as an alternative, further embodiments of the method may include that at least one sensor of the one or more sensors is a proximity sensor, wherein the measured airflow characteristic does not meet or exceed the minimum airflow criteria if the proximity sensor detects an object within a predetermined proximity to a wall of the container.

In addition to one or more of the features described above, or as an alternative, further embodiments of the method may include that the indicator is one of a light or a noise provided at the container, the method further comprising activating said light or noise.

In addition to one or more of the features described above, or as an alternative, further embodiments of the method may include that the indicator is a message transmitted to a user, the method further comprising transmitting said message.

In addition to one or more of the features described above, or as an alternative, further embodiments of the method may include a plurality of containers, each container having one or more sensors, wherein the method further comprises monitoring each of the plurality of containers with the controller.

In addition to one or more of the features described above, or as an alternative, further embodiments of the method may include that, when one container of the plurality of containers has associated received data that does not meet or exceed the minimum airflow criteria, the method further comprises identify which of the plurality of containers does not meet or exceed the minimum airflow criteria.

In addition to one or more of the features described above, or as an alternative, further embodiments of the method may include that the predetermined information is based on a cargo configuration loaded into the container.

In addition to one or more of the features described above, or as an alternative, further embodiments of the method may include performing the comparison after loading of the container.

Technical effects of embodiments of the present disclosure include a systems and processes for checking and monitoring proper airflow within a container such that improper loading may be detected and/or proper airflow within the container may be maintained.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
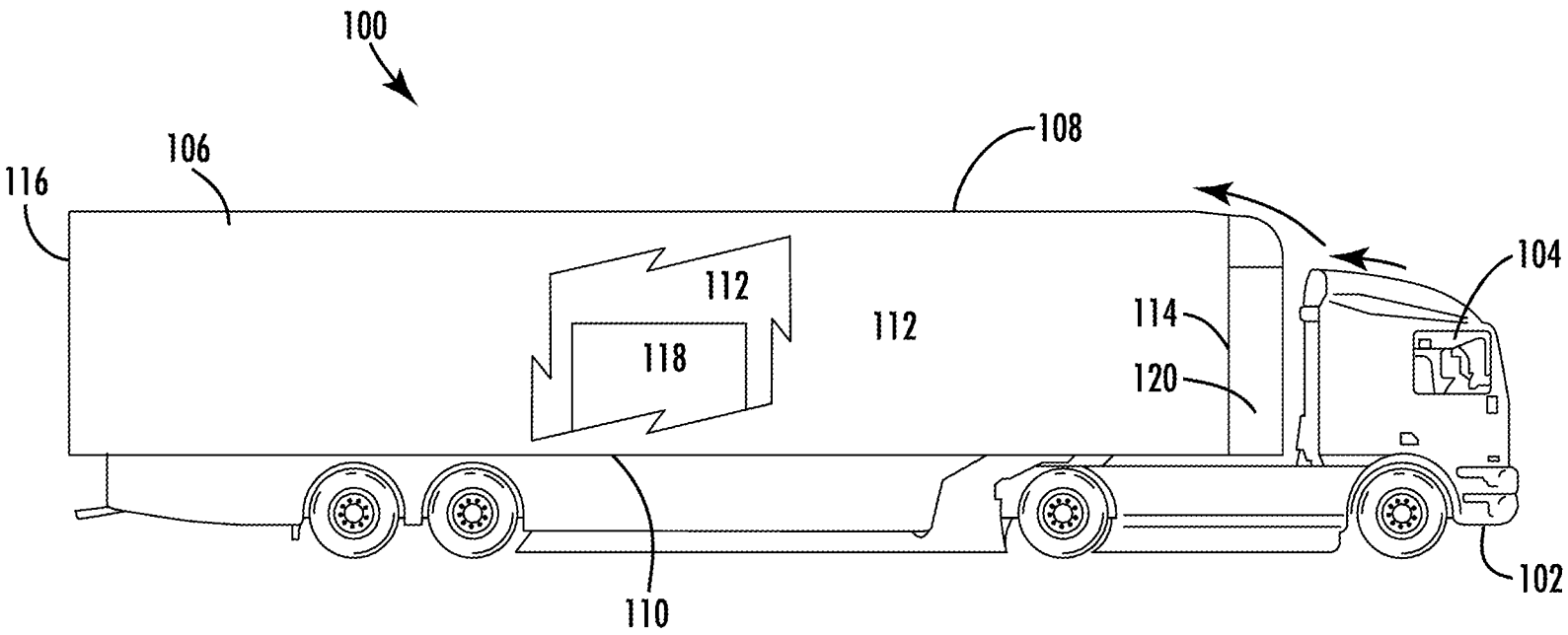
FIG. 1A is a schematic view of an exemplary embodiment of a trailer system having a container with a refrigeration unit and a cargo compartment.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Shown in FIG. 1A is a schematic of an embodiment of a trailer system 100. The trailer system 100 includes a tractor 102 including an operator's compartment or cab 104 and also including an engine, which acts as the drive system of the trailer system 100. A container system 106 is coupled to the tractor 102. The container system 106 is a refrigerated trailer and includes a top wall 108, a directly opposed bottom wall 110, opposed side walls 112, and a front wall 114, with the front wall 114 being closest to the tractor 102. The container system 106 further includes a door or doors (not shown) at a rear wall 116, opposite the front wall 114. The walls of the container system 106 define a cargo space. The container system 106 is configured to maintain a cargo 118 located inside the cargo space at a selected temperature through the use of a refrigeration unit 120 located on or next to the container system 106. The refrigeration unit 120, as shown in FIG. 1A, is located at or attached to the front wall 114.

Figure 1B:
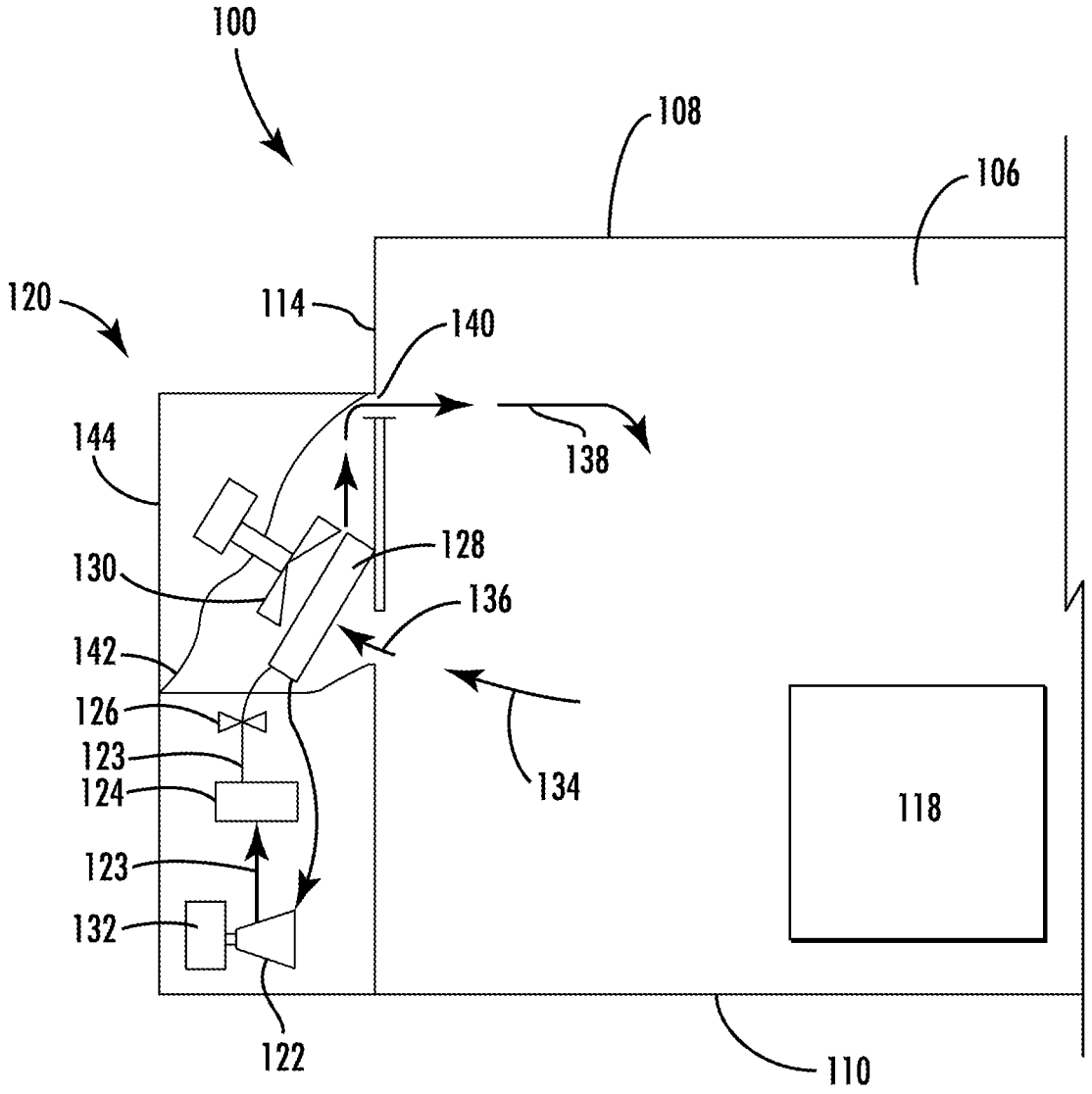
FIG. 1B is a schematic view of an exemplary embodiment of a refrigeration unit for a cargo compartment of the container system of FIG. 1A.

Referring now to FIG. 1B, the refrigeration unit 120 is shown in more detail. The refrigeration unit 120 includes a compressor 122, a condenser 124, an expansion valve 126, an evaporator 128, and an evaporator fan 130. The compressor 122 is operably connected to a refrigeration engine 132 which drives the compressor 122. The refrigeration engine 132 is connected to the compressor in one of several ways, such as a direct shaft drive, a belt drive, one or more clutches, and/or via an electrical generator. A refrigerant line 123 fluidly connects the components of the refrigeration unit 120.

Airflow is circulated into and through the cargo space of the container system 106 by means of the refrigeration unit 120. A return airflow 134 flows into the refrigeration unit 120 from the cargo space of the container system 106 through a refrigeration unit inlet 136, and across the evaporator 128 via the evaporator fan 130, thus cooling the return airflow 134 to a selected or predetermined temperature. The cooled return airflow 134, now referred to as supply airflow 138, is supplied into the cargo space of the container system 106 through a refrigeration unit outlet 140, which in some embodiments is located near the top wall 108 of the container system 106. The supply airflow 138 cools the cargo 118 in the cargo space of the container system 106. It is to be appreciated that the refrigeration unit 120 can further be operated in reverse to warm the container system 106 when, for example, the outside temperature is very low.

The refrigeration unit 120 is positioned in a frame 142 and contained in an accessible housing 144, with the frame 142 and/or the housing 144 secured to an exterior side of the front wall 114 such that the refrigeration unit 120 is positioned between the front wall 114 and the tractor 102, as shown in FIG. 1A.

It will be appreciated by those of skill in the art that the systems and configurations of FIGS. 1A and 1B are merely exemplary and provided for illustrative and descriptive purposes only. The disclosure is not limited thereby. For example, although a tractor-trailer configuration is shown, systems may be employed in other container configurations, in various truck configurations, and/or in other systems and configurations. Further, as will be appreciated by those of skill in the art, the container and cargo space may be configured as a sea container, and thus may be configured to stack with other containers and be shipped on a shipping vessel.

In any particular configuration of the trailers provided herein, proper loading of cargo within a cargo space may be important for maintaining proper cargo temperatures. That is, cargo may be loaded into a trailer or other cargo space at temperature and the cargo may need to be cooled or refrigerated, and the refrigeration unit may enable continuous temperature control of the cargo within the container. To provide cooling throughout the cargo space, airflow must be allowed to pass throughout the entire cargo space and interact with and cool the cargo.

Figure 2:
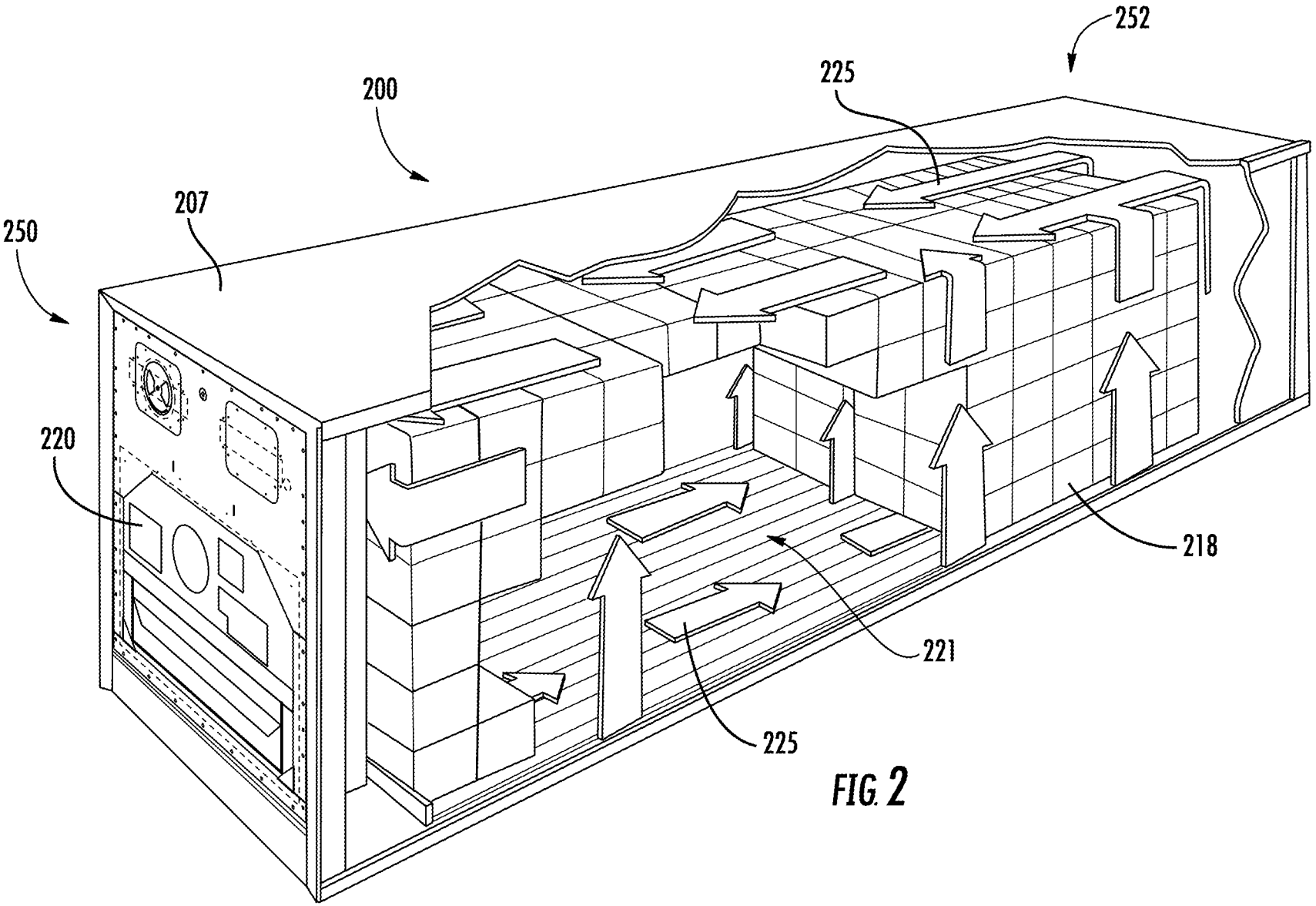
FIG. 2 is a schematic illustration of a container and cargo contained therein.

For example, referring now to FIG. 2, a container system 200 is shown. The container system 200 may include a container 207 defining a cargo space 221 and have a refrigeration unit 220. Cargo 218 may be loaded into the container 207. The cargo 218 may require cooling or refrigeration during storage and/or transport within the container 207. As shown, an airflow 225 is shown by the arrows within the cargo space 221. The airflow 225 may be generated by the refrigeration unit 220 and may be blow or conveyed throughout the cargo space 221 of the container system 200. The airflow may pass under the cargo 218, such as through pallets or between items of cargo 218, travel up the walls of the container 207, and then may return back toward the refrigeration unit 220. As will be appreciated by those of skill in the art, the path of the airflow 225 indicated by the arrows may be reversed with air moving along a top of the container 207 and return along the bottom of the container 207.

It is noted that the refrigeration unit 220 may be located at a first end 250 of the container 207. At a second end 252 of the container 207 may be doors (not shown) that are openable such that cargo 218 may be loaded into the cargo space 221 and further may be closed to define an enclosed cargo space 221 that may be refrigerated by the refrigeration unit 220.

Figure 3:
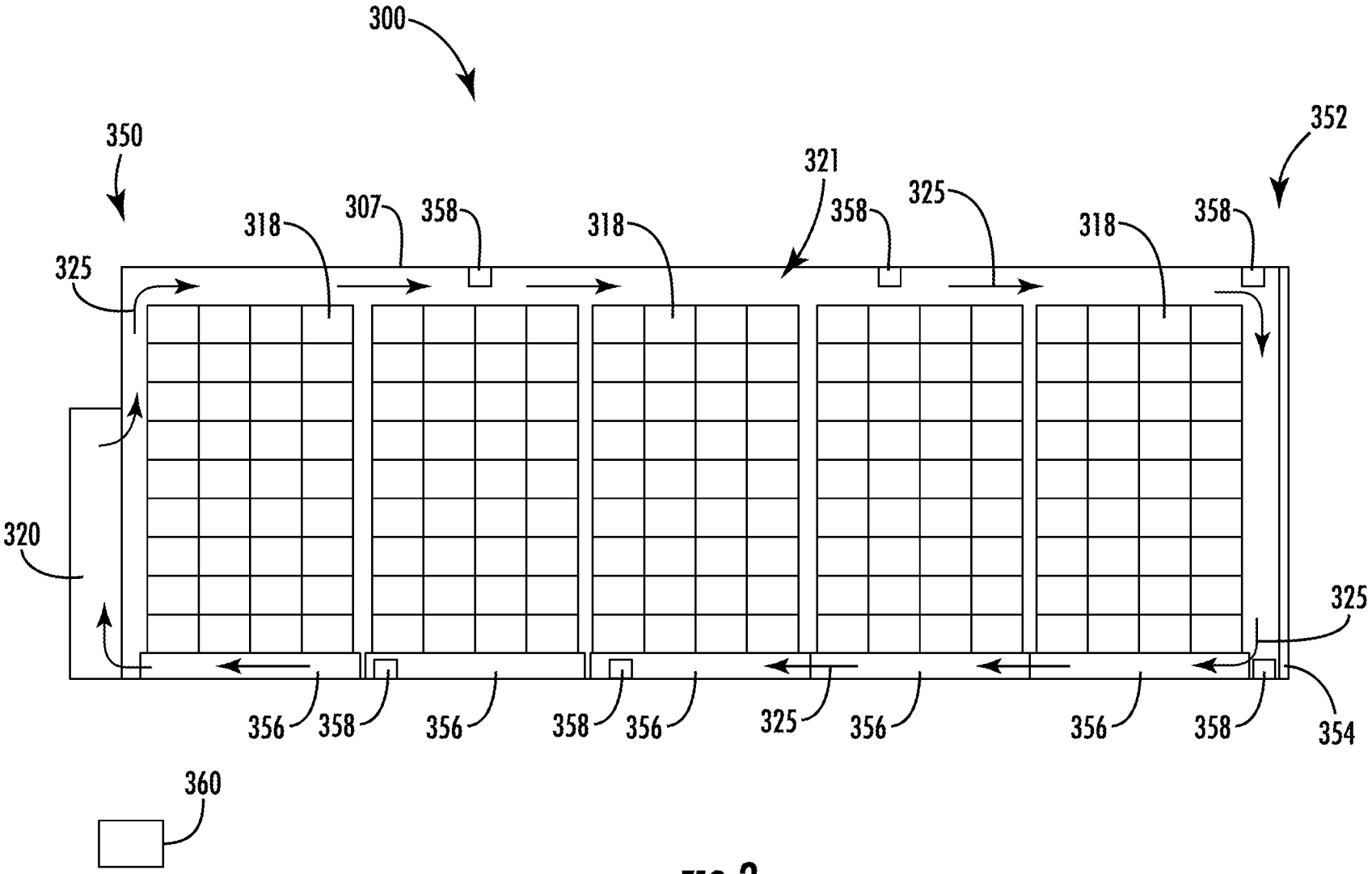
FIG. 3 is a schematic illustration of a container configured in accordance with an embodiment of the present disclosure.

Turning now to FIG. 3, a container system 300 in accordance with a non-limiting embodiment of the present disclosure is shown. The container system 300 includes a container 307 having a refrigeration unit 320 located at a first end 350 and a door 354 located at a second end 352. The container 307 defines a cargo space 321 extending from the first end 350 to the second end 352. Cargo 318 may be loaded into the cargo space 321. As shown, the cargo 318 may be stacked or located on one or more pallets. As shown, the refrigeration unit 320 may be configured to generate an airflow 325 within the cargo space 321, as indicated by the arrows in FIG. 3. The airflow 325 may be expelled upward from the refrigeration unit 320 at the first end 350, pass along a top of the cargo space 321, fall downward along the door 354 at the second end 352 of the cargo space 321, and return to the refrigeration unit 320 by flowing along the bottom of the cargo space 321 (e.g., through and/or under the cargo 318, such as through the pallets 356).

Further, as shown, the container system 300 may be configured with one or more sensors 358 that may be located at one or more locations within the cargo space 321. The sensors 358 may be airflow characteristic sensors configured to detect airflow characteristics such as air temperature, and/or other airflow characteristics, and/or may be sensors configured to detect physical characteristics of loaded cargo, including position within the cargo space 321. In one non-limiting embodiment, a single sensor may be located proximate to the doors 354, i.e., the point farthest from the refrigeration unit 320. In some such embodiments, the sensor may be mounted to the doors 354, to the ceiling, to the floor, or even to a pallet 356 that is loaded last into the container 307. In other embodiment, for example as shown in FIG. 3, multiple sensors 358 may be located throughout the cargo space 321 of the container 307.

The sensors 358 may be in communication with a controller 360 that may be remote from the container 307. However, as will appreciated by those of skill in the art, the controller 360 may be configured within or on a part of the container 307, and/or may be configured as part of a controller of the refrigeration unit 320. The controller 360 may be a computer or other processing device, and may contain a processor and/or memory for storing programs and/or applications. The communication between the sensors 358 and the controller 360 may be by wired or wireless communications, including but not limited to hard wiring, Wi-Fi, Infrared, Bluetooth®, near field communication, etc.

The controller 360 may be configured with predetermined information regarding minimum airflow criteria, including but not limited to minimum and/or maximum air flow and air temperature, and/or storage criteria, including but not limited to cargo position. The sensors 358 may be configured to monitor airflow characteristics related to the predetermined information such that the controller 360 may compare sensor data with the predetermined information to determine if the cargo 318 that is loaded into the cargo space 321 is properly loaded and may be properly cooled by air flowing through the container 307. As such, the sensors 358 may include thermometers, air speed sensors, proximity sensors, etc. that are configured to assist in determining airflow within the container 307.

In one example, the controller 360 may be configured with one or more predetermined data that characterize a properly loaded container, e.g., cargo may be properly cooled and airflow within the container is not obstructed. In one non-limiting embodiment, the predetermined data may be a minimum airflow path requirement. Upon loading the container 307 with cargo 318, a user may close the door 354 to seal the container 307 closed. The refrigeration unit 320 may then be activated and begin distributing air into the container 307. The air from the refrigeration unit 320 will generate and airflow that may be detected by the one or more sensors 358 and/or one or more sensors 358 may detect part of the cargo 318 is leaning on a wall of the container 307 or has fallen to block an airflow path, indicated by the arrows of airflow 325.

If it is determined that airflow within the container 307 is improper, i.e., does not match the predetermined data, the controller 360 may be configured to provide an indicator, such as an alarm, message, or other notification, that the airflow 325 within the container 307 is improper. The indicator may be used to indicate that the cargo 318 is improperly loaded into the container 307 and the cargo 318 should be adjusted for proper loading.

In some embodiments, the indicator may be a light or speaker that is attached to and/or in proximity with the container such that a person that loaded the container may be notified that the cargo is improperly loaded. For example, a flashing light and/or an announcement may be provided at the container itself. In some embodiments, the notification may be an email, text message, or other notification sent from the controller to a user of the system, such as a person in charge of a cargo area at a seaport. Accordingly, personnel loading the container may be notified that the airflow within the container is obstructed and the cargo should be reloaded or adjusted to allow for proper airflow within the container.

In some embodiments, the controller 360 may be in communication with a number of containers 307 each configured with sensors 358. The controller 360 may be configured to determine if one or more of the containers 307 have obstructed airflow, and further the controller 360 may be configured to identify which of a plurality of containers 307 has an obstructed airflow. This may be beneficial for when a container 307 is moved and the cargo 318 within the container 307 may shift and block a necessary airflow within the container.

Figure 4:
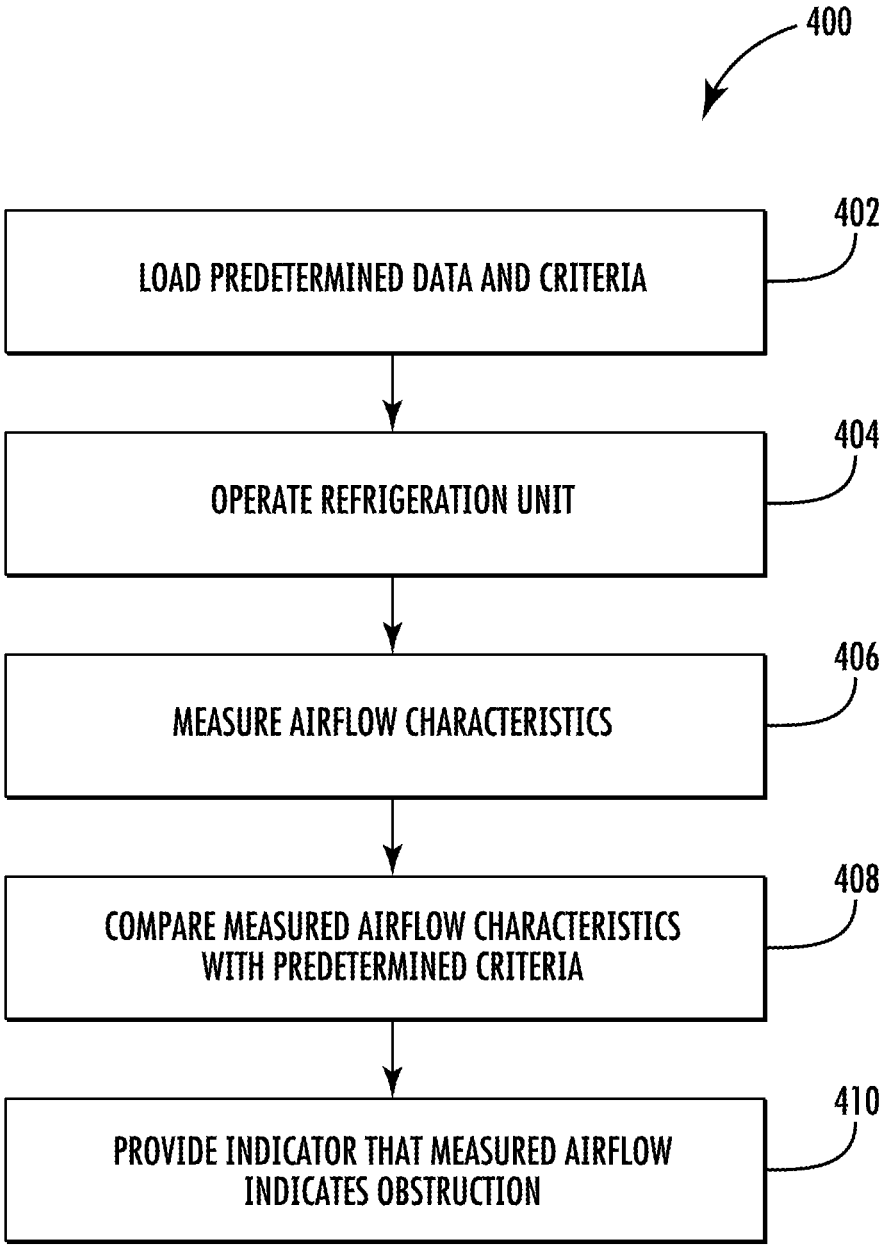
FIG. 4 is a flow process in accordance with an embodiment of the present disclosure.

Turning now to FIG. 4, a flow process in accordance with a non-limiting embodiment of the present disclosure is shown. The flow process 400 shown in FIG. 4 may be performed by a controller or other device that is in communication with one or more sensors that are located within a container. For example, in one non-limiting embodiment, the flow process 400 may be performed by the controller 360 shown in FIG. 3.

The controller may load predetermined data and/or criteria, as shown at block 402. The predetermined data and criteria may be information related to airflow within a container. For example, the predetermined data may be airflow speed, temperatures at various locations, items in proximity to walls or the floor of the container, etc. The predetermined data may represent one or more known values that represent proper or adequate airflow within the container such that any cargo may be properly cooled or maintained at a desired temperature.

In some embodiments, the predetermined data may be a generic set of data for any cargo loading configuration. That is, in some embodiments, the predetermined data may be the same for any loading configuration. In other embodiments, the predetermined information may be dependent upon a particular cargo configuration as loaded. Further, in some embodiments, the predetermined data may be based on the particular cargo, such that depending on what is loaded into the container may influence a particular set of predetermined data.

The predetermined data may be loaded prior to, during, or after a container is loaded with cargo. If a particular loading configuration is determined to be used, the system may load predetermined data associated with the particular loading configuration.

At block 404, a refrigeration unit of the container may be operated. As will be appreciated by those of skill in the art, the container may be closed or sealed prior to operating the refrigeration unit. The operation of the refrigeration unit of the container will generate an airflow used to cool or maintain a temperature within the container for the cargo therein. The refrigeration unit may be configured to generate a directional airflow within the container that allows for recycling of the air while conditioning the air to desired temperature and/or humidity levels.

At block 406, the controller may receive information regarding the airflow from one or more sensors, measured airflow characteristics. In some embodiments, the sensors may be air speed sensors that measure a speed of airflow at one or more locations within the container. Alternatively, or in combination therewith, the sensors may include proximity sensors that are configured to detect if cargo or a portion thereof (or other objects) block an airflow path such as by leaning against a wall of the container or falling between pallets on the floor of the container. Further, the sensors may be temperature sensors that are configured to detect temperature changes at one or more locations within the container. Other types or combinations of sensors may be used and employed without departing from the scope of the present disclosure.

The controller may then compare the measured airflow characteristics with the predetermined data or criteria, as shown at block 408. The comparison may be performed by the controller or other computer processor that includes a processing unit and/or memory for processing data obtained from the one or more sensors, receiving the predetermined data and/or criteria, and performed a comparison of the two data.

When it is determined that the measured airflow characteristics do not meet or satisfy the predetermined data, the controller may be configured to provide an indicator that there is an obstruction or other impediment to the airflow within the container, as shown at block 410. For example, the controller may receive data regarding airflow that indicates an airflow that is insufficient to maintain cargo at a desired temperature. The data may be air speed data, collected at one or more locations within the container. The comparison made by the controller may be comparing a measured airflow speed with a minimum airflow speed that is predetermined to be required at a particular sensor location to indicate proper airflow and cooling within the container. In another configuration, the comparison may be a measured distance made by, e.g., a proximity sensor or IR sensor and a predetermined distance or clearance at a particular measured location. For example, it may be determined that a specific clearance or gap between the cargo and the walls of the container is necessary for proper airflow, and if anything blocks this flow path the sensors may detect an obstruction.

The indicator provided by the controller at block 410 may be a flashing light on the container to indicate to a person in proximity to the container to be notified of the improper airflow. In some embodiments, the indicator may be a notification or alert in a computer program that may be used by a user. Further, in some embodiments, the indicator may be a message (e.g., text or email) that is sent to a user of the system.

As will be appreciated by those of skill in the art, the flow process 400 may be performed after a container is loaded such that the flow process 400 may be a post-loading pre-check prior to the container being approved for transportation and/or storage. For example, the flow process 400 may be prompted by the locking or closing of the exterior doors of the container, to ensure that cargo loaded into the container was properly loaded. As such, the flow process may be an airflow check (i.e., check for proper airflow) after cargo is loaded into the container.

Advantageously, embodiments described herein provide a system for making post-loading checks on proper airflow within a container that holds cargo. Advantageously, in accordance with various embodiments, proper cooling of cargo may be ensured with systems and processes described herein. Moreover, advantageously, improper or wrong loading conditions of cargo within a container may be detected and corrected, thus reducing cargo claims and/or damage to cargo due to improper cooling conditions. Further, advantageously, as provided herein, a user may be notified of improper loading of cargo and the loading conditions and configurations may be adjusted to allow for proper cooling. Additionally, advantageously, in accordance with some embodiments, remote notification and monitoring of multiple containers may be enabled such that embodiment provided herein may be used in cargo yards and/or shipping yards where many containers may be collected and/or stored with cargo contained within the containers.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, although a container having a refrigeration unit is shown and described, those of skill in the art will appreciate that the systems and processes may be used and employed with other storage mechanisms, such as storage rooms, coolers, chillers, etc., particularly configurations that may be loaded, and then closed such that a user may not visually inspect the contents after a cargo space is closed.

Further, although described with respect to loading of a container, those of skill in the art will appreciate that the systems and processes described herein may be used during transportation and/or storage of cargo within containers. For example, the process described herein may be employed at various intervals and/or upon demand by a user, after a container is closed, such that a user may detect if the airflow within the container becomes obstructed during transport of the container.

Accordingly, the present disclosure is not to be seen as limited by the foregoing description, but is only limited by the scope of the appended claims.

What is claimed is:

1. A system for checking airflow within a container having a refrigeration unit, the system comprising:

one or more sensors located within the container configured to measure at least one airflow characteristic; and a controller in communication with the one or more sensors, the controller configured to:

store predetermined information related to airflow within the container, wherein the predetermined information includes minimum airflow criteria related to the at least one airflow characteristic;

receive data from the one or more sensors;

compare the received data with the predetermined information; and provide an indicator when the comparison indicates that the received data does not meet or exceed the minimum airflow criteria, wherein at least one sensor of the one or more sensors is a proximity sensor, wherein the measured airflow characteristic does not meet or exceed the minimum airflow criteria if the proximity sensor detects an object within a predetermined proximity to a wall of the container.

2. The system of claim 1, wherein at least one additional sensor of the one or more sensors is an airspeed sensor, wherein the measured airflow characteristic does not meet or exceed the minimum airflow criteria if the airflow speed sensor detects an airspeed below the minimum airflow criteria.

3. The system of claim 1, wherein the indicator is one of a light or a noise provided at the container.

4. The system of claim 1, wherein the indicator is a message transmitted to a user.

5. The system of claim 1, further comprising a plurality of containers, each container having one or more sensors, the system further comprising the controller in communication with each of the plurality of containers.

6. The system of claim 5, wherein, when one container of the plurality of containers has associated received data that does not meet or exceed the minimum airflow criteria, the indicator is configured to identify which of the plurality of containers does not meet or exceed the minimum airflow criteria.

7. The system of claim 1, wherein the predetermined information is based on a cargo configuration loaded into the container.

8. The system of claim 1, wherein the controller is configured to perform an airflow check after loading of the container.

9. A method for checking airflow within a container having a refrigeration unit, the method comprising:

loading, at a controller, predetermined information related to airflow within the container, wherein the predetermined information includes minimum airflow criteria;

measuring, with one or more sensors, at least one airflow characteristic related to the predetermined information;

receiving, at the controller, data from the one or more sensors;

comparing the received data with the predetermined information; and providing an indicator when the comparison indicates that the received data does not meet or exceed the minimum airflow criteria, wherein at least one sensor of the one or more sensors is a proximity sensor, wherein the measured airflow characteristic does not meet or exceed the minimum airflow criteria if the proximity sensor detects an object within a predetermined proximity to a wall of the container.

10. The method of claim 9, wherein at least one additional sensor of the one or more sensors is an airspeed sensor, wherein the measured airflow characteristic does not meet or exceed the minimum airflow criteria if the airflow speed sensor detects an airspeed below the minimum airflow criteria.

11. The method of claim 9, wherein the indicator is one of a light or a noise provided at the container, the method further comprising activating said light or noise.

12. The method of claim 9, wherein the indicator is a message transmitted to a user, the method further comprising transmitting said message.

13. The method of claim 9, further comprising a plurality of containers, each container having one or more sensors, wherein the method further comprises monitoring each of the plurality of containers with the controller.

14. The method of claim 13, wherein, when one container of the plurality of containers has associated received data that does not meet or exceed the minimum airflow criteria, the method further comprises identify which of the plurality of containers does not meet or exceed the minimum airflow criteria.

15. The method of claim 9, wherein the predetermined information is based on a cargo configuration loaded into the container.

16. The method of claim 9, further comprising performing the comparison after loading of the container.

* * * * *